United States Patent [19]

Brasted et al.

[11] Patent Number: 4,720,214

[45] Date of Patent: Jan. 19, 1988

[54] MUDMAT DESIGN

[75] Inventors: Lee K. Brasted, Kingwood, Tex.; Edward S. Piter, Tulsa, Okla.

[73] Assignee: Shell Offshore Inc., Houston, Tex.

[21] Appl. No.: 865,329

[22] Filed: May 21, 1986

[51] Int. Cl.[4] ..... E02B 17/02; E02D 5/74

[52] U.S. Cl. ..... 405/227; 405/224; 405/225

[58] Field of Search ..... 405/8, 195, 196, 203–210, 405/224–228, 211

[56] References Cited

U.S. PATENT DOCUMENTS

| | | | |
|---|---|---|---|
| 2,171,672 | 9/1939 | Plummer | 255/1 |
| 2,210,408 | 8/1940 | Henry | 61/46 |
| 2,895,301 | 7/1959 | Casagrande | 61/46.5 |
| 3,928,982 | 12/1975 | Lacroix | 61/50 |
| 3,987,639 | 10/1976 | Harrison | 61/86 |
| 4,052,861 | 10/1977 | Malone et al. | 405/225 X |
| 4,069,681 | 1/1978 | Mott | 405/226 |
| 4,106,302 | 8/1978 | Vogel | 61/94 |
| 4,307,977 | 12/1981 | Haney | 405/227 |
| 4,537,533 | 8/1985 | Hampton | 405/227 |

FOREIGN PATENT DOCUMENTS 2079826 1/1982 United Kingdom ..... 405/207

*Primary Examiner*—Nancy J. Stodola

[57] ABSTRACT

A method and apparatus for positioning an offshore well substructure on the ocean floor. A substructure having a heigth of 1350 feet and base of 400 feet by 480 feet is subject to significant lateral forces caused by wind, wave, and current forces between the time period of lowering it to the ocean floor and driving piles through its skirt sleeves and into the ocean floor. Mudmats carried by the bottom corners of the substructure have downwardly-extending peripheral walls which penetrate the ocean floor so as to resist any lateral force to which the substructure is subjected. The base of a mudmat is approximately 10,000 square feet and the walls are approximately five feet high. A manifold system carried by each mudmat provides the capability of adjusting the level of the substructure after it has been lowered onto the ocean floor.

18 Claims, 5 Drawing Figures

FIG. 1
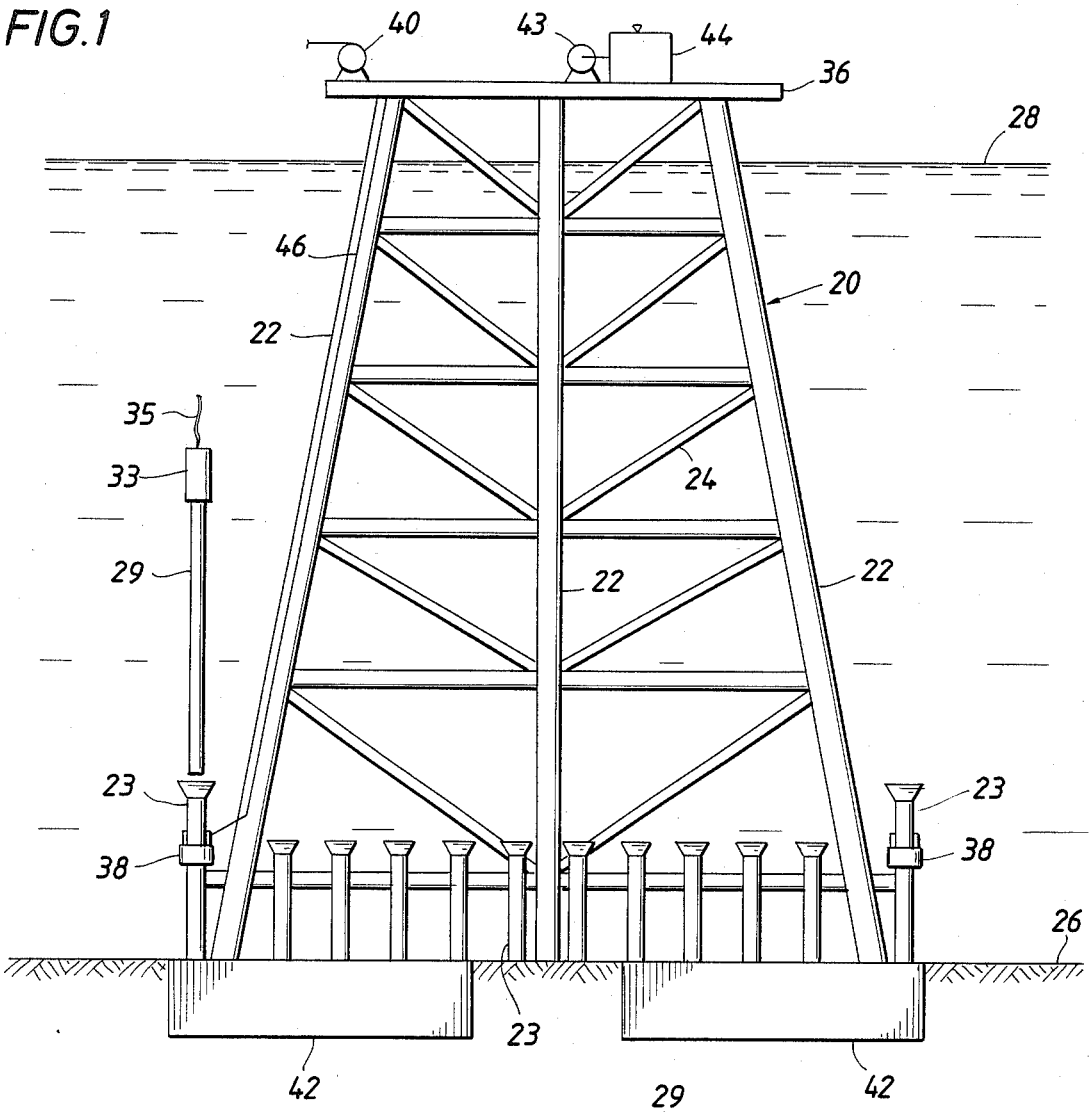
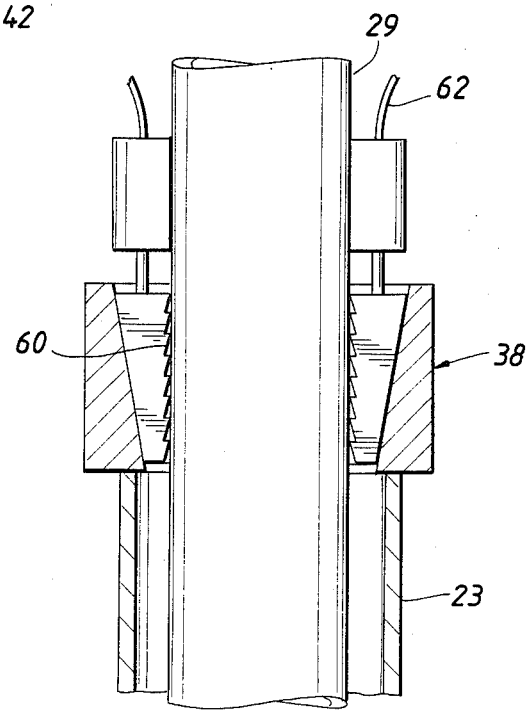
FIG. 5

MUDMAT DESIGN

FIELD OF THE INVENTION

This invention relates to amethod and apparatus for positioning an offshore platform substructure or jacket on the ocean floor, said apparatus being equipped with anchoring means which will resist lateral and vertical movement for the period of time say, a week or more, between lowering the jacket onto the ocean floor until anchoring piles are driven into the ocean floor and connected to the jacket.

BACKGROUND OF THE INVENTION

Present day offshore platforms used in the oil and gas industry in deep waters (e.g., 1000 feet or more) are generally subject to significant lateral and vertical forces caused by wind, wave, and current forces prior to driving or installing piles through legs or skirt pile sleeves of the substructure and into the ocean floor.

It is the object of this invention to provide a method and apparatus for positioning an offshore platform substructure on the ocean floor so as to anchor temporarily the substructure prior to driving all of the piles in the substructure's sleeves or legs for permanent anchoring.

It is a further object of the present invention to provide a method and apparatus for leveling an offshore platform on the ocean floor while preventing any lateral movement of the platform base.

SUMMARY OF THE INVENTION

The present invention is directed to a method and apparatus for positioning an offshore well substructure on the ocean floor. One substructure, for example. consists of a single section which is approximately 1350 feet tall with a base of 400 feet by 480 feet. Once lowered onto the ocean floor the substructure extends above the ocean surface and therefore, is subject to wind, wave, and current forces which may cause significant lateral forces to be applied to the substructure causing movement thereof prior to driving the piles through skirt pile sleeves or legs of the substructure and into the ocean floor. Mudmats, which are affixed to or constructed with the bottom corners of the jacket, are provided with downwardly-extending peripheral walls that penetrate the ocean floor so as to resist any lateral force to which the substructure is subjected. These walls, which may be approximately five feet in height together with a steel cover or roof attached to the top of the walls, form at least one buoyant chamber therein. The base of each mudmat in the present example is approximately 10,000 square feet in area.

As the jacket is lowered to cause the mudmats to penetrate intot he ocean floor, the water that is trapped between the mudmats and the ocean floor is discharged through ports located in the walls of each chamber of the mudmats. Once the water has been discharged, the valves connected to these ports are then closed. The core of earth that each mudmat is pushed down into prevents normal vertical or lateral movement of the substructure.

A pile is driven through at least one leg or pile sleeve carried by and adjacent to the lowest corner or corners of the jacket. An assessment is made to determine whether the centerline of the jacket is sufficiently vertical or whether the base of the platform jacket is level. If not, the lowermost bottom portion of the jacket is raised by deballasting any of its flooded components and/or by injecting gas into a manifold distribution system of the mudmat associated with the bottom portion of the jacket. The pile is then secured to the jacket by actuating a clamping device to grip the pile and prevent vertical movement of the entire platform jacket relative to the pile. The pile is then permanently affixed to the jacket by grouting, welding or a combination thereof.

An advantage of the present invention is that the mudmats resist the lateral forces to which the substructure may be subjected prior to driving the piles into the sleeves of the substructure.

Another advantage of this invention is that it provides the capability of adjusting the level of a substructure once it is lowered onto the ocean floor.

The various features of novelty which characterize the invention are pointed out with particularity in the claims forming a part of this disclosure. For a better understanding of the invention, its operating advantages and specific objects obtained by its uses, reference should be made to the accompanying drawings and descriptive matter inw hich there are illustrated preferred embodiments of the invention.

BRIEF DESCRIPTION OF THE DRAWINGS

FIG. 1 is a diagrammatic view of an offshore well installation having mudmats affixed thereto and penetrating the ocean floor;

FIG. 5 is a cross-sectional schematic view of a pile gripping device.

DESCRIPTION OF THE PREFERRED EMBODIMENT

Figure 2:
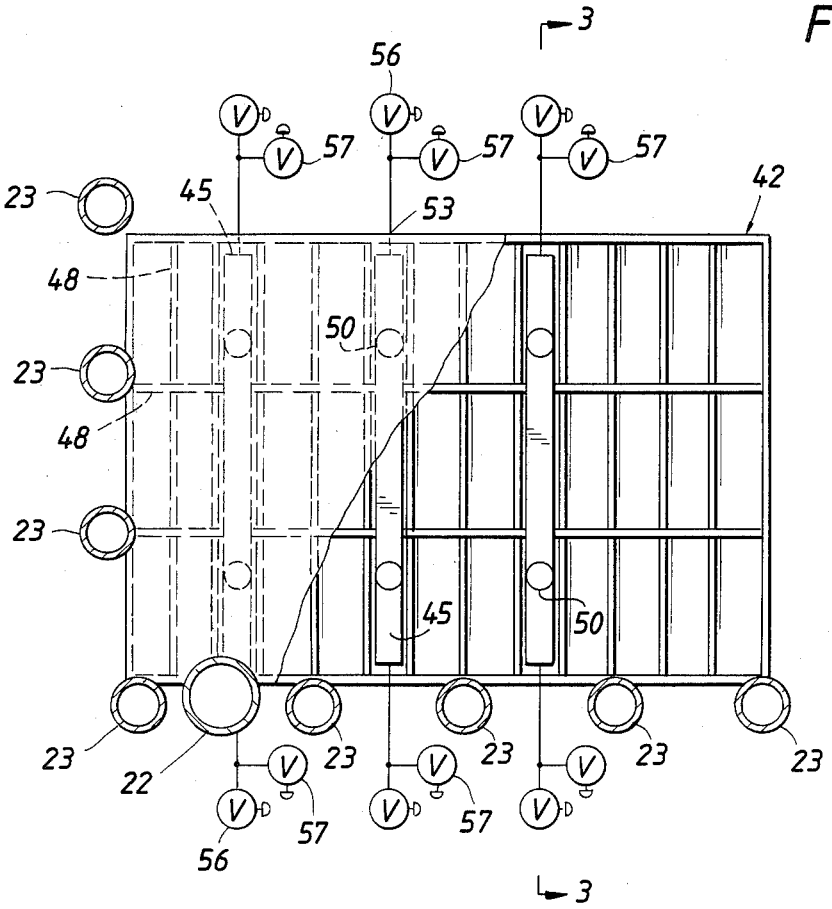
FIG. 2 is a plan view of girder and trough arrangement forming the water drainage system and the gas injection manifold of the mudmats.

Referring to FIG. 1 of the drawing, an offshore platform substructure or jacket, generally represented by number 20, may comprise a plurality of substantially vertical legs 22, interconnected by any arrangement of cross-bracing members 24. The legs 22 extend upwardly from the seabed or ocean floor 26 to a suitable level, say 12 feet, above the water surface 28. After the jacket 20 is lowered to the ocean floor 26, it is generally secured to the ocean floor 26 by driving piles 29 through the substantially vertical tubular sleeves 23, which are fixedly secured to the bottom of the jacket 20 around its periphery, and into the ocean floor. This is accomplished using a pile driver or an underwater hammer 33 lowered by a cable 35 powered by a compressor 40 or in any manner well known to the art.

Figure 3:
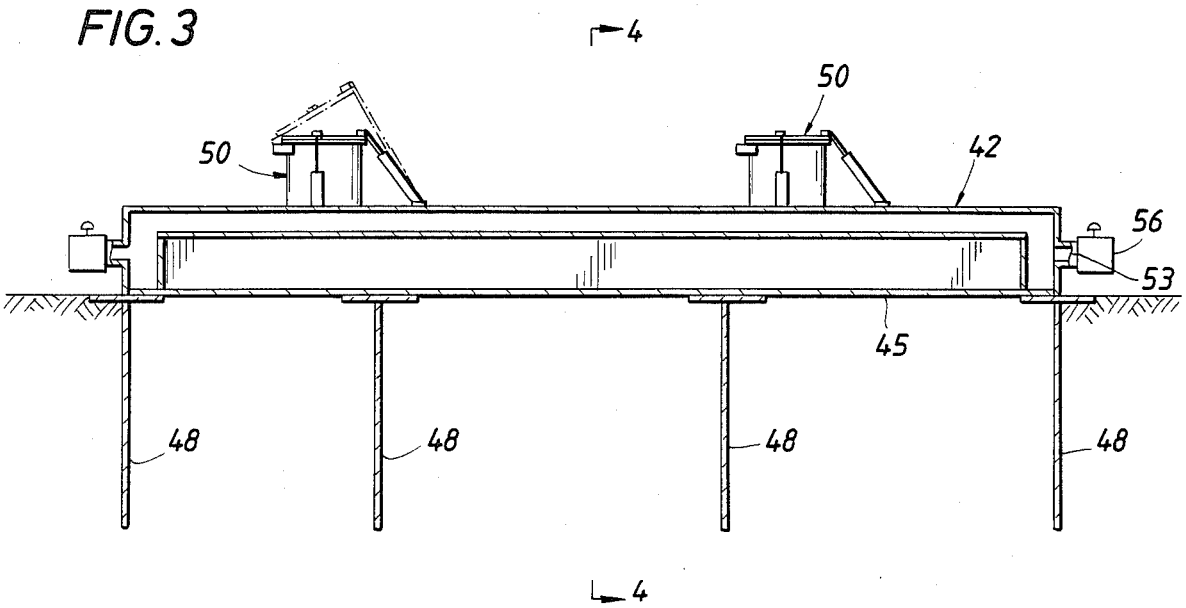
FIG. 3 is a side view taken along line 3—3 of FIG. 2.
Figure 4:
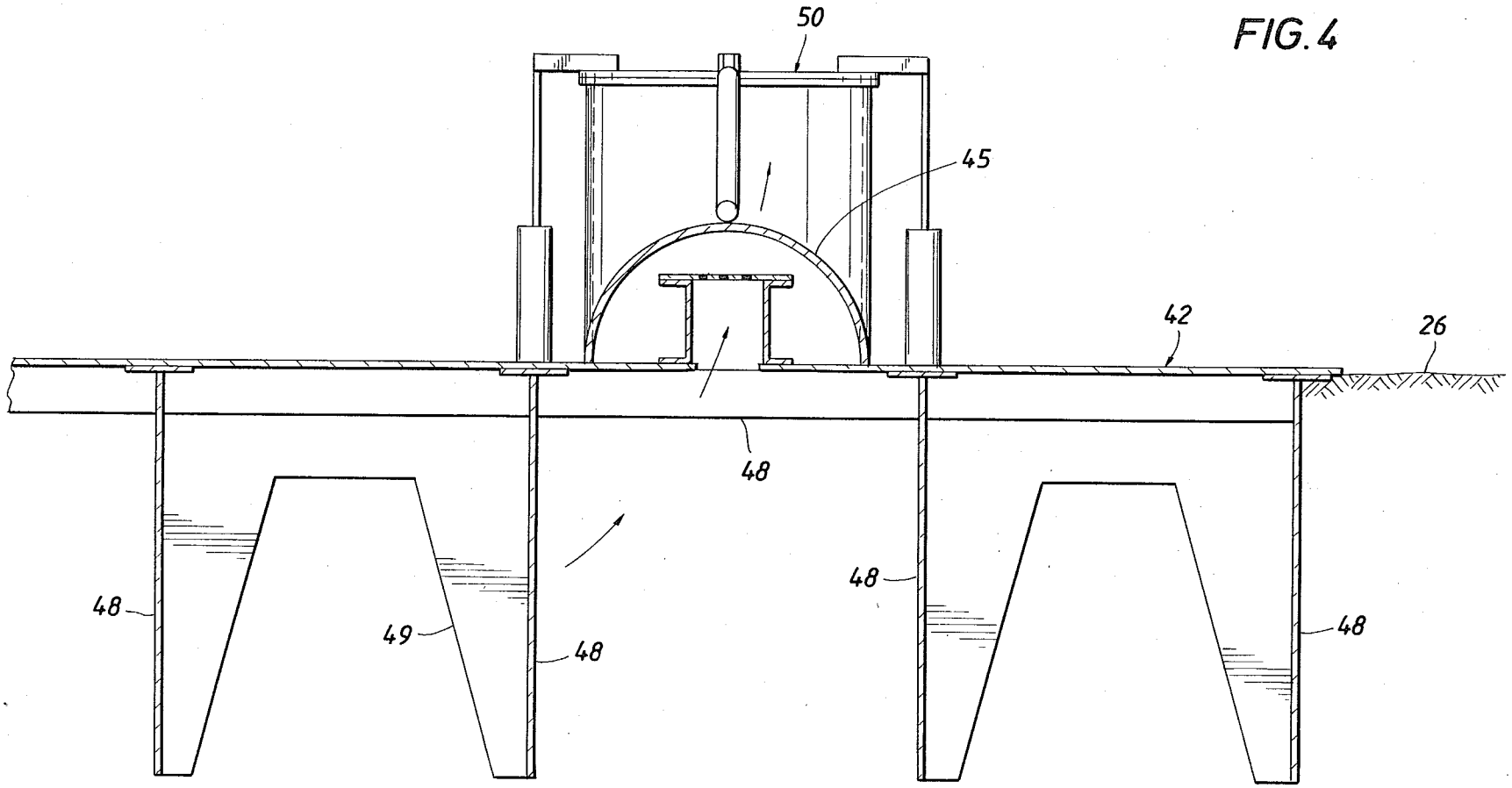
FIG. 4 is a cross-sectional schematic view taken along line 4—4 of FIG. 3.

Additionally, the jacket 20 is secured to the ocean floor 26 by mudmats 42 which are affixed to the bottom of the jacket 20 and have downwardly extending peripheral walls, say five feet, for penetrating into the ocean floor. The mudmat 42 drainage manifold system, shown in FIG. 2, allows water trapped between the roof of the mudmat 42 and the ocean floor 26 to be carried by conduits or troughs 45 and drained either by sluice gates 50 or ports 53 through the wall of the mudmat 42 which are controlled by valves 56 (FIG. 3). Channels formed by girders 48 and webs 49 which extend normal to the conduits also allow fluid transport into the conduit 45 for discharge through the sluice gate 50 (FIG. 4). The channels and conduits 45 also form a manifold system for distributing gas beneath the mudmats 42.

An assessment is made to determine whether a portion of the bottom of the jacket 20 (FIG. 1) is lower relative to the remaining portion positioned on the ocean floor 26.

A pile 29 is driven through at least one sleeve 23 associated with the lowermost portion of the jacket 20. Then, the lowermost portion of the jacket 20 is raised until the centerline of the jacket is substantially vertical.

Raising the lowermost portion of the jacket 20 is accomplished by deballasting any suitable jacket compartment or by injecting jas under pressure beneath one or more selected mudmats from a gas source located on the deck 36 of the platform jacket 20, or elsewhere, into the conduits 45 (FIG. 2) by opening valves 57 connected to gas inlet ports 53 through at least one wall of the mudmats 42.

The pile 29 (FIG. 1) is then secured to the sleeve 23 by any suitable actuating holding and anchoring means 38 well known to the art which is affixed to and carried at the lower end of the jacket 20, at least one of the anchoring means 38 being mounted adjacent each corner of the jacket 20 or carried by a pile sleeve at that location. The clamping means 38 grips the pile so as to prevent vertical movement of the sleeve 23 relative to the pile 29 and maintains the desired elevation of the jacket 20. For example, teeth 60 (FIG. 5) or an expandable gripping seal (not shown) may be actuated by a power transmission source 62, such as a hydraulic or pneumatic transmission hose, thereby gripping the pile 29 to secure it. The pile 29 may then be grouted to the sleeve 23 of the jacket 20.

The pile 29 may be grouted to the sleeve 23 of the jacket 20 by pumping 43 grout from a slurry hopper 44 down a pipe or hose 46 which is secured to a leg 22 and in communication with the inside of the pile sleeve 23 so as to pump grout slurry between the sleeve 23 and the pile 29 driven therethrough. Alternatively, the pile 29 may be welded to the leg 22 of the jacket 20 in a manner well known to the art.

Thus, it can be seen that the above-mentioned objective may be accomplished, based on the description of the preferred embodiment, by practicing the above-described method.

What is claimed is:

1. An apparatus for positioning and levelling an offshore platform jacket on the ocean floor and restraining it against lateral and vertical movement, said jacket comprising;

a plurality of substantially vertical legs having cross-bracing members, said legs being arranged in a closed pattern and adapted to extend downwardly to the ocean floor when positioned thereon;

a plurality of substantially vertical tubular sleeves fixedly secured to the bottom of said jacket at spaced intervals around the periphery thereof, said sleeves adapted to receive anchoring piles driven through said sleeves for securing said jacket to the ocean floor;

a plurality of holding and anchoring means for securing said piles to said sleeves affixed to and carried at the lower end of said jacket, at least one of said anchoring means being mounted adjacent each corner of said platform; and mudmat footing means affixed to the bottom of the jacket and having a downwardly extending peripheral wall forming at least one chamber therein, said wall being adapted to penetrate the ocean floor.

2. The apparatus of claim 1 wherein said holding and anchoring means includes remotely actuatable pile engaging and anchoring means adapted to engage and fixedly position said pile within said sleeve to prevent vertical movement of said sleeve relative to said pile.

3. A method for positioning and levelling an offshore platform jacket on the ocean floor, the method comprising:

affixing a mudmat to the bottom of the jacket for penetrating the ocean floor;

lowering said jacket onto the ocean floor;

determining whether a portion of the bottom of the jacket is lower relative to the remaining portion positioned on the ocean floor;

driving a pile through at least one pile sleeve carried by and adjacent to the lowermost portion of the jacket;

raising the lowermost portion of the jacket by injecting gas under pressure beneath said mudmat footing carried by the jacket until the jacket is substantially level; and securing said sleeve to said pile.

4. The method of claim 3 wherein the step of injecting gas into said footing means comprising:

providing water discharge port means through at least one wall of said footing means, providing gas inlet port means through at least one wall of said footing means, providing valve means connected to said water discharge port means, providing valve means connected to said gas inlet port menas, closing said valve means connected to said water discharge outlet port means, and opening selected valve means connected to said gas inlet port means prior to supplying gas under pressure beneath said mudmat footing means into said at least one chamber.

5. The method of claim 3 wherein the step of securing said pile to said sleeve comprises:

providing clamping means for fixedly securing at least one pile adjacent to each corner of said jacket, actuating clamping means to grip the pile and maintain the desired elevation of said jacket, and injecting grout slurry in a space between said pile and said sleeve.

6. The method of claim 3 wherein the lowering of said jacket onto the ocean floor includes the step of draining the water between said mudmat and the ocean floor.

7. An apparatus for positioning and levelling an offshore platform jacket on the ocean floor and restraining it against lateral and vertical movement, said jacket comprising:

substantially vertical legs having cross-bracing members, said legs being arranged in a closed pattern and adapted to extend downardly to the ocean floor when positioned thereon;

substantially vertical tubular sleeves fixedly secured to the bottom of said jacket at sapaced intervals around the periphery thereof, said sleeves adapted to receive anchoring piles driven through said sleeves for securing said jacket to the ocean floor;

holding and anchoring means for securing said piles to said sleeves affixed to and carried at the lower end of said jacket, at least one of said anchoring means being mounted adjacent each corner of said platform;

mudmat footing means affixed to the bottom of the jacket and having a downwardly extending peripheral wall forming at least one chamber therein, said wall being adapted to penetrate the ocean floor; and a drainage manifold system operably attached to said mudmat footing means, said system including internal walls downwardly extending from the roof of said mudmat footing means to form at least one chamber therein for surrounding and containing a volume of ocean floor when stabbed into said floor, conduit means carried by said footing means for transporting fluid therein, water discharge port means through at least one wall of said footing means and carried by said conduit means for discharging water from said at least one chamber, gas inlet port means through at least one wall of said footing means and carried by said conduit means for introducing gas into said at least one chamber, valve means connected to said water discharge port means for controlling water flow from said at least one chamber, and valve means connected to said gas inlet port means for allowing gas to flow into said at least one chamber.

8. The apparatus of claim 7 wherein said footing means includes vertical walls of a selected height that extend into the ocean floor.

9. The apparatus of claim 7 wherein said inlet and discharge port means are located at said at least one chamber of said footing means.

10. The apparatus of claim 7 wherein said inlet and discharge port means are manifolded between said chambers to form a drainage manifold system.

11. The apparatus of claim 7 wherein said conduit means include lateral troughs for transporting fluid therein.

12. The apparatus of claim 11 wherein said conduit means include channels extending normal to said troughs for transporting fluid therein.

13. An apparatus for positioning and levelling an offshore jacket on the ocean floor and restraining it against lateral and vertical movement, said jacket comprising:

a plurality of substantially vertical legs having cross-bracing members, said legs being arranged in a closed pattern and adapted to extend downwardly to the ocean floor when positioned thereon;

a plurality of substantially vertical tubular sleeves fixedly secured to the bottom of said jacket at spaced intervals around the periphery thereof; said sleeves adapted to receive anchoring piles driven through said sleeves for securing said jacket to the ocean floor;

a plurality of holding and anchoring means for securing said piles to said sleeves affixed to and carried at the lower end of said jacket, at least one of said anchoring means being mounted adjacent each corner of said jacket, said holding and anchoring means includes remotely actuatable pile engaging and anchoring means adapted to engage and fixedly position said pile within said sleeve to prevent vertical movement of said sleeve relative to said pile; and mudmat footing means affixed to the bottom of the jacket and having a downwardly extending peripheral wall forming at least one chamber therein, said wall being adapted to penetrate the ocean floor.

14. An apparatus for positioning and levelling an offshore substructure on the ocean floor and restraining it against lateral and vertical movement, said substructure comprising:

a plurality of substantially vertical legs having cross-bracing members, said legs being arranged in a closed pattern and adapted to extend downwardly to the ocean floor when positioned thereon;

a plurality of substantially vertical tubular sleeves fixedly secured to the bottom of said substructure at spaced intervals around the periphery thereof, said sleeves adapted to receive anchoring piles driven through said sleeves for securing said substructure to the ocean floor;

a plurality of holding and anchoring means for securing said piles to said sleeves affixed to and carried at the lower end of said substructure, at least one of said anchoring means being mounted adjacent each corner of said substructure, and mudmat footing means affixed to the bottom of the substructure and having a downwardly extending peripheral wall forming at least one chamber therein, said wall being adapted to penetrate the ocean floor.

15. An apparatus for positioning and levelling an offshore substructure on the ocean floor and restraining it against lateral and vertical movement, said substructure comprising:

a plurality of substantially vertical legs having cross-bracing members, said legs being arranged in a closed pattern and adapted to extend downwardly to the ocean floor when positioned thereon;

a plurality of substantially vertical tubular sleeves fixedly secured to the bottom of said substructure at spaced intervals around the periphery thereof, said sleeves adapted to receive anchoring piles driven through said sleeves for securing said substructure to the ocean floor;

a plurality of holding and anchoring means for securing said piles to said sleeves affixed to and carried at the lower end of said jacket, at least one of said anchoring means being mounted adjacent each corner of said substructure, said holding and anchoring means includes remotely actuatable pile engaging and anchoring means adapted to engage and fixedly position said pile within said sleeve to prevent vertical movement of said sleeve relative to said pile; and mudmat footing means affixed to the bottom of the substructure and having a downwardly extending peripheral wall forming at least one chamber therein, said wall being adapted to penetrate the ocean floor.

16. A mudmat footing apparatus for positioning and levelling an offshore substructure on the ocean floor and restraining it against lateral and vertical movement, said apparatus comprising:

a downardly extending peripheral wall adapted to penetrate the ocean floor, a drainage manifold system operably attached to said mudmat footing apparatus, said system including internal walls downwardly extending from the roof of said mudmat footing appartus to form at least one chamber therein for surrounding and containing a volume of ocean floor when stabbed into said floor; means for transporting fluid, said means carried by said mudmat footing apparatus; means for discharging water from said chambers, said means located through at least one wall of said mudmat footing apparatus and carried by said means for transporting fluid; means for introducing gas into said chambers, said means located through at least one wall of said mudmat footing apparatus and carried by said means for transporting fluid; means for controlling water flow from said chambers, said means operably connected to said means for discharging water; and means for allowing gas to flow into said chambers, said means operably connected to said means for introducing gas into said chambers.

17. A method for positioning and levelling an offshore platform substructure on the ocean floor, the method comprising:

providing mudmat footing means affixed tot he bottom of the substructure for penetrating the ocean floor;

providing pile sleeves fixedly secured to said substructure adjacent the lower end thereof;

lowering said substructure onto the ocean floor;

determining whether a portion of the bottom of the substructure is lower relative to the remaining portion positioned on the ocean floor;

driving a pile through at least one pile sleeve carried by and adjacent to the lowermost portion of the substructure;

raising the lowermost portion of the substructure by injecting gas under pressure beneath said mudmat footing means carried by the substructure and;

securing said sleeve to said pile.

18. The method of claim 17 wherein the step of securing said pile to said sleeve comprises:

providing clamping means for fixedly securing at least one pile adjacent to each corner of said substructure, actuating clamping means to grip the pile and maintain the desired elevation of said substructure, and injecting grout slurry in a space between said pile and said sleeve.

* * * * *